US005433426A

United States Patent [19]

Bond

[11] Patent Number: 5,433,426

[45] Date of Patent: Jul. 18, 1995

[54] APPARATUS FOR REMOVING A NON-MAGNETIC SHEET FROM A STACK OF SHEETS

[76] Inventor: Irvin D. Bond, 10270 Allen Rd., Clarkston, Mich. 48348

[21] Appl. No.: 247,880

[22] Filed: May 23, 1994

[51] Int. Cl.[6] ..... B65H 3/40

[52] U.S. Cl. ..... 271/92; 271/104; 271/106

[58] Field of Search ..... 271/91, 100, 102, 104, 271/106, 92, 93

[56] References Cited

U.S. PATENT DOCUMENTS

| | | | |
|---|---|---|---|
| 1,644,549 | 10/1927 | Streeper | 271/104 |
| 1,861,605 | 6/1932 | Maass | 271/104 |
| 2,108,702 | 2/1938 | Backhouse | 271/92 X |
| 2,225,006 | 12/1940 | Gudger et al. | 271/93 |
| 2,338,050 | 12/1943 | Nelson et al. | 271/14 |
| 2,661,948 | 12/1953 | Montgomery | 271/12 |
| 2,869,867 | 1/1959 | Backhouse | 271/93 |
| 2,950,913 | 8/1960 | Staines | 271/92 |
| 3,224,757 | 12/1965 | Parke et al. | 271/10 |
| 3,322,301 | 5/1967 | Bliss | 271/106 X |
| 3,330,554 | 7/1967 | Staines | 271/92 |
| 3,409,149 | 11/1968 | Graux | 214/8.5 |
| 3,584,866 | 6/1971 | Ross et al. | 271/12 |
| 3,669,445 | 6/1972 | Wallis | 271/106 |
| 3,682,469 | 8/1972 | Itoh | 271/12 |
| 3,718,217 | 2/1973 | Stobb et al. | 271/106 X |
| 3,866,764 | 2/1975 | Leiser | 271/106 X |
| 3,937,457 | 2/1976 | Schwebel | 271/92 |
| 4,067,458 | 1/1978 | Schneider et al. | 214/8.5 |
| 4,382,593 | 5/1983 | Beran et al. | 271/104 X |
| 4,540,167 | 9/1985 | Tamura et al. | 271/104 X |
| 5,083,763 | 1/1992 | Hartta | 271/92 X |

FOREIGN PATENT DOCUMENTS

| | | | |
|---|---|---|---|
| 0061542 | 5/1980 | Japan | 271/106 |
| 0136838 | 6/1986 | Japan | 271/106 |
| 0155135 | 7/1986 | Japan | 271/106 |
| 0295343 | 12/1988 | Japan | 271/104 |
| 0123049 | 5/1990 | Japan | 271/104 |
| 0032422 | 2/1992 | Japan | 271/106 |
| 0045032 | 2/1992 | Japan | 271/104 |
| 2111024 | 6/1983 | United Kingdom | 271/104 |

*Primary Examiner*—H. Grant Skaggs
*Assistant Examiner*—Carol L. Druzbick
*Attorney, Agent, or Firm*—Charles W. Chandler

[57] ABSTRACT

Apparatus for destacking individual sheets from a stack of non-magnetic mutually clinging metal sheets includes a structure adjacent the side edge of the sheets having a series of vertically spaced horizontal ridges. A series of vacuum cups raise the edge of the top sheet such that the sheet bends in a curve. The second sheet clings by an adhesive film to the top sheet. Both sheets engage the ridged structure, but the top sheet continues to be raised while the second sheet is caught by the ridges until the adhesive film between the sheets releases the top sheet.

3 Claims, 4 Drawing Sheets

APPARATUS FOR REMOVING A NON-MAGNETIC SHEET FROM A STACK OF SHEETS

BACKGROUND OF THE INVENTION

This invention is related to apparatus for removing individual sheets from the top of a stack of metal sheets which may be non-magnetic.

Stacks of magnetic sheets are commonly used in various industries, such as the automotive industry, where they are individually removed from the top of a stack and transferred to a stamping press or other metal forming apparatus.

The conventional approach for destacking magnetic sheets is to use vacuum cups to raise the top sheet from the stack. See for example, U.S. Pat. No. 3,409,149, which was issued Nov. 5, 1968, to Pierre Graux for "Apparatus for Removing Ferromagnetic Sheets Singly from a Stack". Other forms of sheet pickup devices may be found in U.S. Pat. No. 2,338,050, which was issued Dec. 28, 1943, to George E. Nelson and Carl E. Magnus for "Sheet Supporting Means for Tin Plate Sheet Feeders"; U.S. Pat. No. 2,661,948, which was issued Dec. 8, 1953, to William G. Montgomery for "Sheet Pickup and Feeder"; U.S. Pat. No. 3,224,757, which was issued Dec. 21, 1965, to Franklin E. Parke and Hugh Ross for "Magnetic Sheet Transferring Apparatus"; U.S. Pat. No. 3,584,866, which was issued Jun. 15, 1971, to Hugh Ross and Franklin E. Parke for "Magnetic Conveyor"; U.S. Pat. No. 3,682,469, which was issued Aug. 8, 1972, to Yohnosuke Itoh et al. for "Device for Handling Plates with Smooth Surface"; U.S. Pat. No. 4,067,458, which was issued Jan. 10, 1978, to Franz Schneider et al. for "Apparatus for the Unstacking and Transportation of Blanks".

Aluminum stampings, in some applications, are replacing steel stampings, but are not suited for magnetic type destacking devices. The destacking problem occurs for both magnetic and non-magnetic sheets because a thin film of oil between the sheets creates an adhesion condition which makes it difficult to raise one sheet from a vertical stack of sheets.

Consequently, aluminum sheets are manually separated sheet by sheet. Mechanical devices have met with limited success.

SUMMARY OF THE INVENTION

The preferred embodiment of the invention provides a method and apparatus for destacking individual sheets from a stack of metal sheets, which may be non-magnetic. A pair of opposed, upright plates with horizontal ridges are mounted adjacent opposite side edges of the stack of sheets. The distance between the plates is slightly greater than the width of the sheets. The plates are inclined toward one another so the distance between the plates above the stack is less than the sheet width.

A set of vacuum cups raise the top sheet adjacent the ridged plates. The second sheet also rises with the top sheet because of the adhesion between the sheets. The edges of the rising sheets engage the horizontal ridges of the plates. The edges of the second sheet are caught or snagged by the ridges thereby releasing the top sheet. The sheet is then shuttled to its destination.

The preferred apparatus provides means for quickly destacking a stack of non-magnetic sheets without any significant damage to the side edges of the sheets.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
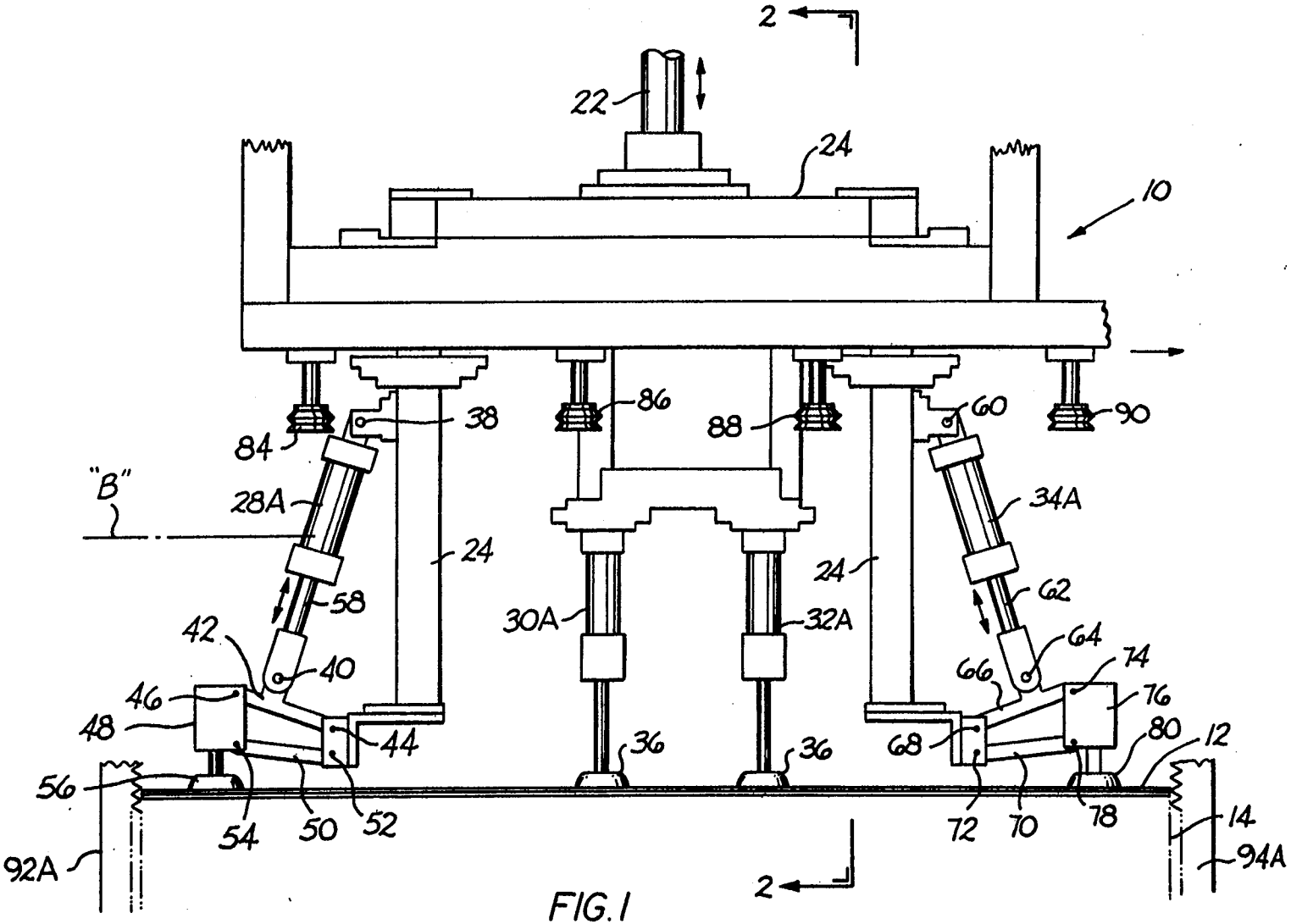
FIG. 1 is a fragmentary elevational view of apparatus for destacking individual sheets from a stack in accordance with the invention.
Figure 2:
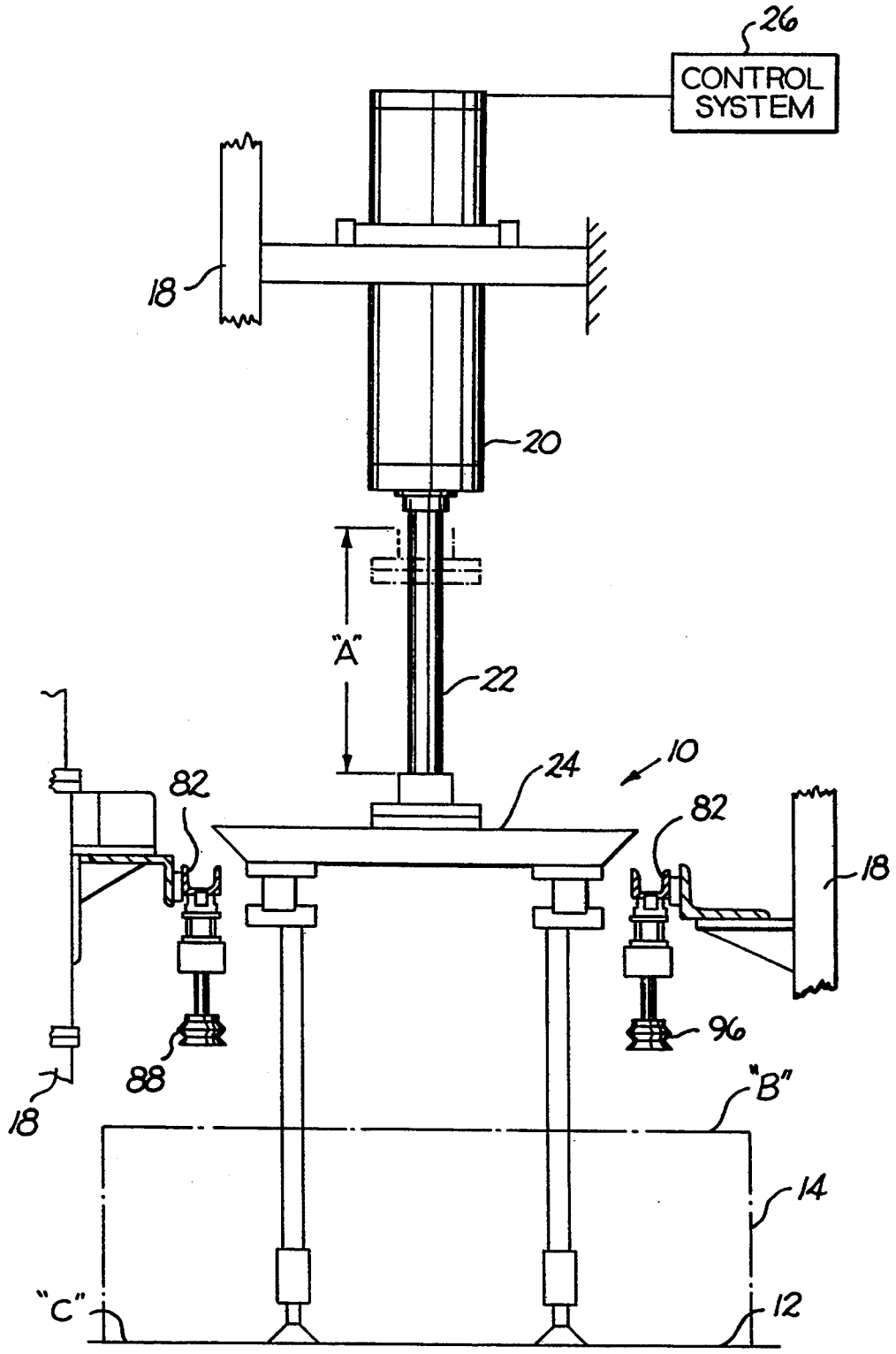
FIG. 2 is a reduced view generally as seen along lines 2—2 of FIG. 1, but with the vacuum cups in their lowermost position.
Figure 3:
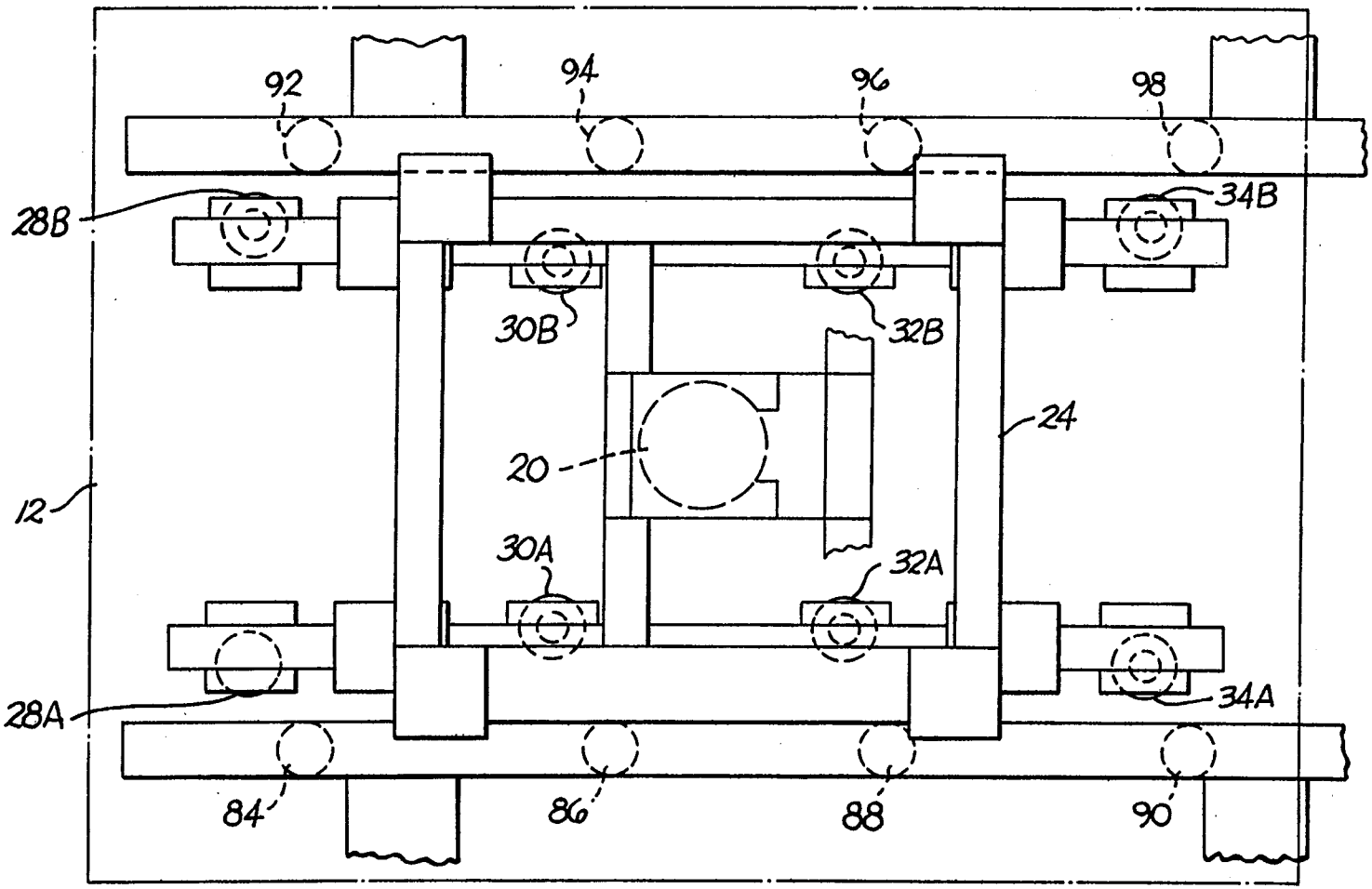
FIG. 3 is a generally plan, fragmentary view of the preferred apparatus showing the location of the various vacuum cups.

Referring to the drawings, FIGS. 1–3 illustrate a preferred apparatus 10 useful for removing the top sheet 12 from a stack of sheets 14. The stack of sheets are metal and may be magnetic or non-magnetic, but for illustrative purposes, are aluminum sheets being individually transferred to a stamping press. The sheets are thin sheets, 48" square. The stack has a full height illustrated at "B". The sheets are individually removed so that the stack height is reduced to "C" as shown in FIG. 2. The sheets normally arrive on a pallet 16, see FIG. 4.

Referring to FIGS. 1 and 2, apparatus 10 has a fabricated base structure 18. A pneumatic piston and cylinder actuator 20 having a piston rod 22 is mounted on the base. For illustrative purposes, actuator 20 may have an 8" bore with a vertical 25" rod stroke, illustrated at "A" in FIG. 2. The stroke is greater than the distance between the upper and lower heights of the stack, which may be about 16".

Piston rod 22 carries a generally rectangular frame structure 24 which is raised or lowered toward or away from stack 14 in accordance with commands received from an electronic, programmed control system 26.

Frame 24 supports eight smaller pneumatic piston and cylinder actuators 28A, 28B, 30A, 30B, 32A, 32B, 34A and 34B. Actuators 28A and 28B are associated with the left side of top sheet 12, as illustrated in FIG. 1. Actuators 30A, 30B, 32A and 32B are associated with the mid-section of the sheet. Actuators 34A and 34B are associated with the right side edge of the top sheet. The eight actuators are raised and lowered by actuator 20 according to signals received from the control system.

Each individual actuator has its own vertical stroke. Actuators 30A, 30B, 32A and 32B each have a vacuum operated cup 36 adapted to simultaneously engage the mid-section of the top sheet either to restrain it in position or to lift it depending upon the destacking cycle. For illustrative purposes, actuators 30A, 30B, 32A and 32B each have a 1½" cylinder bore with a 3" vertical rod stroke. They are connected by pneumatic lines (not shown) to a source of vacuum or sub-atmospheric pressure and to control system 26, in the manner well known to those skilled in the art.

Actuators 28A and 28B are mounted along the left side of the frame and each has its upper end pivotally connected to frame 24.

Actuator 28A illustrates the manner that actuators 28A and 28B have their upper ends connected by pivots 38 to the frame. The piston rod of each actuator is connected by a pivot 40 to an arm 42. Arm 42 is mounted at right angles to the piston rod, has one end connected by pivot 44 to frame 24, and has its other end connected by pivot 46 to a vacuum cup support 48. A second arm 50 has one end connected by pivot 52 to frame 24 and its opposite end connected by pivot 54 to support 48. A flexible vacuum cup 56 is carried by support 48, and like the other vacuum cups, is connected to a vacuum source, operative to connect the vacuum cups to the top sheet of the stack.

When piston rod 58 is retracted, vacuum cup 56 is swung about pivots 44 and 52 with sheet 12, raising the sheet to form a curve about vacuum cups 36.

Pivotal actuator 28B has an identically acting pivotal vacuum cup arrangement.

Actuator 34A is connected by a pivotal connection 60 to the frame. Piston rod 62 is connected by pivotal connection 64 to an arm 66 that is swingably connected by pivot means 68 to frame 24. A lower arm 70 also is connected by pivotal means 72 to the frame. A pivot means 74 connects arm 66 to a vacuum cup support 76 to form a type of 4 link mechanism. Pivot means 78 connects the outer end of arm 70 to support 76. A flexible vacuum cup means 80 is carried by support 76 and can be raised or lowered by actuator 34A. When the vacuum cup has been swung downwardly to engage top sheet 12, the actuator is retracted to bend the sheet edge with respect to the mid-section of the sheet in a manner that will be presently described. Actuator 34B carries an identical flexible vacuum cup structure on the far side of frame 24 that cooperates with vacuum cup 80 to bend the sheet.

Referring to FIG. 2, a horizontally moveable shuttle rail structure is mounted on base 18 adjacent frame 24 and carries four flexible vacuum cup means 84, 86, 88, and 90 above the near side of the sheet as illustrated in FIG. 1, and four vacuum cup means 92, 94, 96 and 98 above the far side of the sheet. The four vacuum cup units 84–90 and four vacuum cup units 92–98 are outboard of the vacuum cups carried by frame 24. The eight vacuum cups 84–98 carried by conveyor structure 82 are shuttled between a first position above the stack of sheets, and a lateral position to the right of their initial position where the sheet is released for a later operation.

The shuttle rails are reciprocated back and forth between the two positions.

Figure 4:
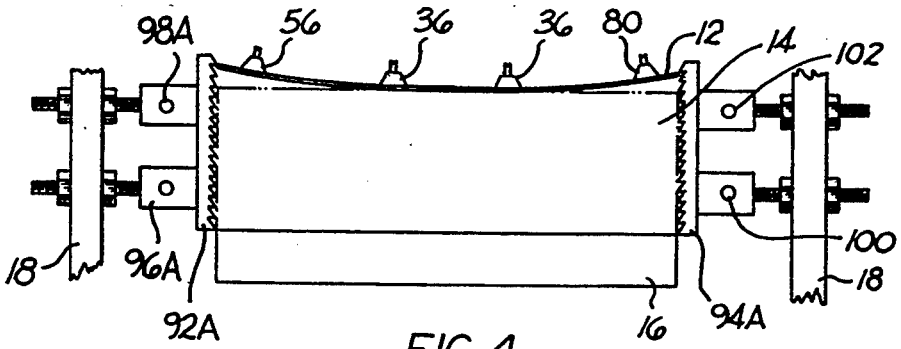
FIGS. 4 and 5 illustrate the lifting process.
Figure 5:
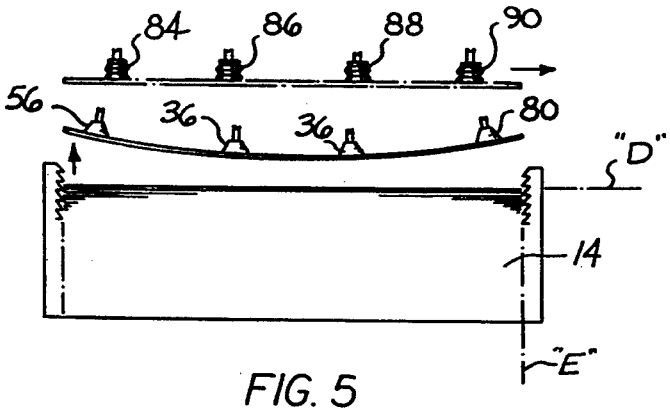
Figure 6:
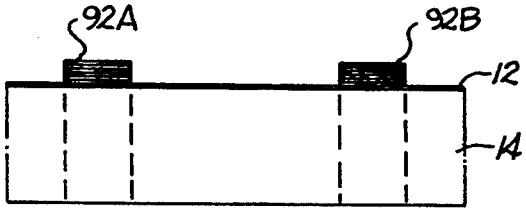
FIG. 6 is an elevational view of a pair of the ridged plates.

Referring to FIGS. 4 and 5, the stack is shown with top sheet 12 in the position it occupies when the stack is substantially its full height. Stack 14 is sandwiched between opposed ridged plates 92A and 94A. FIG. 6 is a view looking toward plate 92A to illustrate the ridges and a companion plate 92B. Plate 94A also has a companion plate 94B, not shown, but which is opposite plate 92B. The two plates have a height that is greater than the full height of stack 14, and a width less than the length of the sheets. Each plate has a series of horizontal ridges supported parallel to the side edges of the sheets.

The horizontal ridges on opposite plates are parallel to one another. The ridges on each plate are identical and disposed with their peaks in a common plane. The left plate 92A is connected by a pair of adjustable pivot means 96A and 98A to the frame so that the upper portion of the plate can be inclined a couple of degrees toward the stack. Similarly, a pair of adjustable pivot means 100 and 102 are mounted on base 18 and connected to plate 94A to slightly incline the upper end of the plate toward the stack.

The angle of the two ridge plates from vertical is adjusted such that the distance between lower portions of the opposed ridge plates is greater than the sheet width, and the distance between the upper portions of the opposed ridge plates is less than the sheet width to catch the side edges of the top sheets as they are being raised.

The aluminum sheets in the stack are resilient and customarily have a light film of oil which causes adjacent sheets to adhere to one another when they are being separated in a direction perpendicular to the plane of the sheet.

Figure 7:
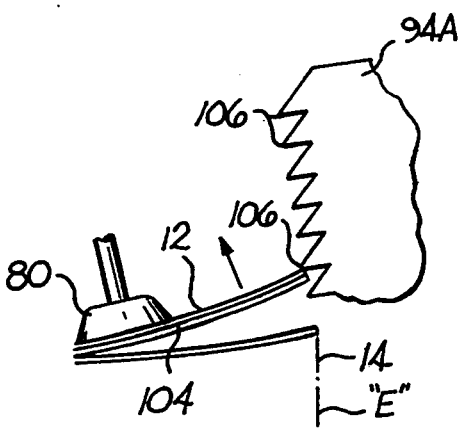
FIG. 7 is an enlarged view illustrating the manner in which the ridges snag the second sheet.

In operation, the vacuum cups carried by frame 24 are lowered toward the top sheet. The second sheet will be disposed in a generally horizontal plane "D" (FIG. 5). The side edges of the stack are generally aligned in a vertical plane "E" closely adjacent the ridges of the ridge plate. The four center vacuum cup units 36 are lowered until they engage the mid-section of the top sheet. They then prevent the mid-section of the sheet from being raised until the center vacuum cups are raised. The pivotal vacuum cups 56 and 80 as well as their companion vacuum cups on the far side of the frame also engage the top sheet. The pivotal vacuum cups are then, in response to a signal from the control system, swung inwardly to raise the right and left edges of the sheet 12 as illustrated in FIGS. 4 and 7.

As the edges of top sheet 12 are raised to bend the sheet, the top sheet will tend to lift one or more lower sheets, such as sheet 104, because of the adhesion between the two sheets. As the sheets are being raised, the sheet edges brush ridges 106 of the adjacent ridge plates 94A and 92A. The edges of the second sheet are caught or snagged by an appropriate ridge 106 depending upon the height of the stack. As the vacuum cups continue their upward motion, the second sheet 104 remains caught with the ridges, sometimes resulting in a slight bowing of the two sheets. In some cases a shaking motion may be applied until the upward force of the vacuum cup on the top sheet overcomes the adhesion between the two sheets, thereby releasing the top sheet from the second sheet. The shaking motion is not usually necessary. The second sheet will tend to return toward its normal flat position because of its inherent resiliency.

When the opposite edges of the top sheet have been released from the second sheet, the actuator 20 then raises vacuum cups 36 to totally separate the top sheet from the second sheet. The two pivotal vacuum cups are then swung downwardly with respect to the center vacuum cups so that the sheet assumes its flat configuration.

Frame 24 is raised until the sheet is engaged by shuttle vacuum cups 84, 86, 88, 90 as well as the companion shuttle vacuum cups on carried on the far side of the frame. The vacuum cups carried by the shuttle are also connected to a source of vacuum (not shown). The vacuum cups carried by frame 24 then pneumatically release the top sheet and then are raised sufficiently to clear the sheet. The shuttle vacuum cups move the sheet toward the right to its next destination. The shuttle vacuum cups then return to their initial position above the stack. The cycle is then repeated to de-stack the next sheet.

Having described my invention, I claim:

1. An apparatus for separating a first resilient planar metal sheet having spaced parallel side edges, from a second resilient similarly-shaped planar metal sheet disposed in surface-to-surface contact with the first sheet, by a lifting motion perpendicular to the plane of the first sheet, comprising:

first means for supporting the first and second sheets in a flat horizontal surface-to-surface position in which a first side edge of the first sheet is adjacent a corresponding side edge of the second sheet, and a second side edge of the first sheet, on the opposite side of the first sheet, is adjacent a corresponding second side edge of the second sheet;

a frame;

first vacuum cup means carried on the frame and disposed above the first sheet for engaging a top surface of the first sheet in a position between the first side edge and the second side edge of the first sheet;

means for lowering the first vacuum cup means to engage the first sheet between said first side edge and said second side edge to temporarily restrain a lifting motion thereof in the area of said engagement with the first vacuum cup means;

second vacuum cup means for engaging a top surface of the first sheet adjacent the first side edge thereof;

first pivot means carried on the frame and disposed above the first sheet between the first vacuum cup means and the second vacuum cup means;

first arm means connecting the first pivot means to the second vacuum cup means for swinging the first arm means with the second vacuum cup means to bend the first side edge of the first sheet in a path of motion both vertically upward and horizontally away from the horizontal portion of the first side edge of the first sheet when the second vacuum cup means is connected to the first sheet and the frame and the first vacuum cup means are stationary;

third vacuum cup means for engaging the top surface of the first sheet adjacent the second side edge thereof;

second pivot means carried on the frame and disposed above the first sheet between the first vacuum cup means and the third vacuum cup means;

second arm means connecting the second pivot means to the third vacuum cup means for swinging the second arm means with the third vacuum cup means to bend the :second side edge of the first sheet in a path of motion both vertically upward and horizontally away from the horizontal position of the second side edge of the first sheet, when the third vacuum cup means is connected to the first sheet, and the frame and the first vacuum cup means are stationary;

ridged structure means disposed adjacent the paths of motion of the first side edge of the first sheet and the second side edge of the first sheet comprising a series of vertically spaced horizontal ridges disposed for catching the second sheet as said side edges of the first sheet are being bent by the second vacuum cup means and the third vacuum cup means until the first and second side edges of the first sheet are separated from the second sheet, and means for raising the first vacuum cup means, the second cup means and the third vacuum cup means with the first sheet above the second sheet.

2. Apparatus as defined in claim 1, in which the second vacuum cup means comprises a pair of vacuum cups spaced in a direction parallel to the first side edge of the first sheet, and the third vacuum cup means comprises a pair of vacuum cups spaced in a direction parallel to the second side edge of the first sheet.

3. A method for separating a first resilient planar metal sheet having spaced parallel side edges, from a second resilient similarly-shaped planar metal sheet disposed in surface-to-surface contact with the first sheet, by a lifting motion perpendicular to the plane of the first sheet, comprising:

supporting the first sheet and the second sheet in a flat horizontal surface-to-surface position in which a first side edge of the first sheet is adjacent a corresponding side edge of the second sheet, and a second side edge of the first sheet, on the opposite side of the first sheet, is adjacent a corresponding second side edge of the second sheet;

lowering a first vacuum cup means to engage an area of the top surface of the first sheet between said first side edge and said second side edge to temporarily restrain a lifting motion thereof in the area of said engagement with the first vacuum cup means;

lowering a second vacuum cup means to engage the top surface of the first sheet adjacent the first side edge thereof;

swinging the second vacuum cup means in a direction both vertically upward and horizontally away from the horizontal position of the first side edge of the first sheet when the second vacuum cup means is connected to the first sheet and the first vacuum cup means is stationary;

lowering a third vacuum cup means to engage the top surface of the first sheet adjacent the second side edge thereof;

swinging the third vacuum cup means in a direction both vertically upward and horizontally away from the horizontal position of the second side edge of the first sheet when the third vacuum cup means is connected to the first sheet, and the first vacuum cup means is stationary;

disposing a series of verticaly spaced horizontal ridges adjacent the path of motion of the first side edge of the first sheet and the second side edge of the first sheet for catching the second sheet as the side edges of the first sheet are being bent by the second vacuum cup means and the third vacuum cup means until the first and the second side edges of the first sheet are separated from the second sheet, and raising the first vacuum cup means, the second cup means and the third vacuum cup means with the first sheet to fully separate the first sheet from the second sheet.

* * * * *